US006805605B2

(12) United States Patent
Reining et al.

(10) Patent No.: US 6,805,605 B2
(45) Date of Patent: Oct. 19, 2004

(54) ELECTRICALLY CONDUCTIVE BLOCK TOY

(76) Inventors: Lynn E. Reining, 8030 Stagecoach Rd., Cross Plains, WI (US) 53528; William N. Reining, 8030 Stagecoach Rd., Cross Plains, WI (US) 53528

( * ) Notice: Subject to any disclaimer, the term of this patent is extended or adjusted under 35 U.S.C. 154(b) by 0 days.

(21) Appl. No.: 10/391,029

(22) Filed: Mar. 17, 2003

(65) Prior Publication Data

US 2004/0185745 A1 Sep. 23, 2004

(51) Int. Cl.[7] ..... A63H 33/04
(52) U.S. Cl. ..... 446/91; 446/484
(58) Field of Search ..... 446/91, 124, 125, 446/128, 484, 118, 90; 439/53

(56) References Cited

U.S. PATENT DOCUMENTS 3,553,883 A * 1/1971 Fisher ..... 446/91
3,696,548 A * 10/1972 Teller ..... 446/91
4,552,541 A * 11/1985 Bolli ..... 446/91
4,556,393 A * 12/1985 Bolli ..... 446/91
4,743,202 A * 5/1988 Bach ..... 439/53
4,883,440 A * 11/1989 Bolli ..... 446/91
5,042,972 A * 8/1991 Bach et al. ..... 446/91
5,088,951 A * 2/1992 Majurinen ..... 446/91
5,848,503 A * 12/1998 Toft et al. ..... 52/173.1
6,062,937 A * 5/2000 Kikuchi ..... 446/91

FOREIGN PATENT DOCUMENTS

GB 2188956 A * 10/1987

OTHER PUBLICATIONS

Lego Mindstorms, Power of Robotics @ Your Command, ROBOTICS Invention System, Constructopedia, 1998, The LEGO Group, pp. 3–47.

* cited by examiner

*Primary Examiner*—Jacob K. Ackun
*Assistant Examiner*—Faye Francis
(74) *Attorney, Agent, or Firm*—Quarles & Brady LLP

(57) ABSTRACT

An electrically conductive block component and method of producing such a block component are disclosed. The electrically conductive block component includes a main block section having first and second faces opposed to one another and a first channel extending through the main block section from the first face to the second face. The electrically conductive block component also includes a first conductive pin positioned within the first channel and having first and second end portions proximate the first and second faces, respectively. The first and second end portions of the first conductive pin are configured so that the electrically conductive block component can be both physically assembled with and electrically coupled to another electrically conductive block component.

18 Claims, 4 Drawing Sheets

ELECTRICALLY CONDUCTIVE BLOCK TOY

FIELD OF THE INVENTION

The present invention relates to children's toys, and more particularly to block toy sets or similar construction systems that include block components or similar parts that can be assembled together to form larger toys.

BACKGROUND OF THE INVENTION

Block toys remain a popular class of toys for children ranging in ages from preschool age up even into the high school years. Such toys include multiple block components that can be connected to and disconnected from one another (or at least positioned in relation to one another) to assemble and disassemble larger toy entities. Among the most versatile of the block toys, in terms of the complexity of the toy entities that can be constructed using the blocks, are the LEGO® toys and similar toys in which the block components have protrusions and indentations that allow multiple blocks to be combined with, and affixed to, one another.

In recent years, the variety of block components available from block toy manufacturers has increased significantly. In particular, some toy manufacturers now provide block systems that include, in addition to standard block components, specialized components such as gear mechanisms or electronic components such as motors, batteries, electric lights, and even programmable computerized control devices. By way of these more complicated block systems, children can now construct toy entities that more closely resemble real-world systems and perform mechanized or automatic operations.

Despite efforts on the part of block toy manufacturers to design these specialized components in such a way as to make the specialized components compatible with standard block components, compatibility between these different components remains a problem. Children who utilize the specialized components in conjunction with the standard block components must be cognizant of the proper manner in which to assemble the components and cautious not to lose any of the specialized components. Further, because the components can only be assembled in a certain manner, children can in some circumstances be precluded from fashioning toys according to their own designs. Indeed, often the aesthetic appearance of the specialized components is substantially different from that of the standard blocks, such that the specialized components detract from the overall appearance of the toy assemblies built using the block systems.

These problems are particularly evident with respect to the implementation of electrical components in block toy systems. To provide power to and from electrical devices such as motors, lights, and batteries, and to communicate electrical control signals from computerized controllers to other electrical devices, electrical pathways must be provided. While wire cables can be employed to provided the desired connections, the use of wires in block toy systems is both functionally and aesthetically incompatible with the general design of the block components. The use of wires is further complicated when multiple signals or voltages (e.g., a voltage differential) are to be transmitted.

FIGS. 1 and 2 (Prior Art) show one existing component 5 for providing electrical connections in a block toy system, which was developed by The LEGO Group, and was also shown in the Robotics Invention System™ Constructopaedia™ building guide published in 1998. As shown in FIGS. 1 and 2, the component 5 includes first and second blocks 10 and 20, respectively, that are coupled to one another by a cable 15. Each block 10,20 is a two-by-two (square) protrusion/indentation LEGO® block. That is, each block 10,20 has a respective first row 25 of two cylindrical protrusions 30 protruding from a respective top side 35 of the respective block, a respective second row 40 of two cylindrical protrusions 30 protruding from the respective top side, a respective first row 45 of two indentations 50 extending inward through a bottom side 55 of the respective block, and a second row 60 of the two indentations 50 extending inward through the bottom side. As is commonly the case in such block toy components, in the embodiment shown the two indentations 50 of each of the first and second rows 45,60 are not separated from one another but instead together form a single rectangular channel.

Further as shown in FIGS. 1 and 2, within each of the blocks 10,20 are first and second electrical conductors 65 and 70. As shown, each of the electrical conductors 65,70 includes a respective flat panel section 75 that is coupled to two protrusion sections 80. The flat panel sections 75 of the first electrical conductors 65 are positioned along first internal walls 85 of each of the first and second blocks 10,20. The flat panel sections 75 of the second electrical conductors 70 are positioned along second internal walls 90 of each of the first and second blocks 10,20. Thus, the flat panel sections 75 of the first and second electrical conductors 65,70 respectively form parts of the indentations 50 of each of the first and second rows of indentations 45,60. The first and second electrical conductors 65,70 respectively extend the entire length of the corresponding first and second internal walls 85,90 of the blocks 10,20 and consequently the pair of indentations 50 of each respective row 45,60 are short circuited with one another. When other block components are attached to the first and second blocks 10,20 by the insertion of protrusions of the other block components into the indentations 50, portions of the protrusions of the other block components are tangent to and in contact with the internal walls 85,90.

The two protrusion sections 80 of the first electrical conductor 65 of each block 10,20 respectively extend into the two protrusions 30 of the second row 40 of protrusions on that block, while the two protrusion sections 80 of the second electrical conductor 70 of each block respectively extend into the two protrusions 30 of the first row 25 of protrusions on that block. As shown, segments 95 of the outer cylindrical surfaces of each of the protrusions 30 that are outward facing towards the planes formed by the first and second internal walls 85,90 are missing. Consequently, portions of the protrusion sections 80 of the first and second electrical conductors 65 and 70 are exposed at each of the protrusions 30.

The cable 15 internally includes first and second wires 100,105. The first wire 100 is coupled between the first electrical conductors 65 of the first and second blocks 10,20 while the second wire 105 is coupled between the second electrical conductors 70 of the first and second blocks. Consequently, the component 5 is configured to allow a voltage differential to be applied at one of the blocks (e.g., at the first block 10) across the first and second conductors 65,70 of that block, such that the voltage differential is then provided at the other of the blocks (e.g., at the second block 20) across its first and second conductors.

The component 5 of FIGS. 1 and 2 provides certain desirable features. In particular, electrical signals/voltages can be applied and delivered at the indentations/protrusions of a block, such that electrical connections can be established between two blocks simply by assembling the blocks in the standard manner. Additionally, the design successfully enables the transmission of a voltage differential over a distance.

Nevertheless, the design of the component 5 limits its usefulness. To begin, the component 5 still employs the cable 15, which is aesthetically inharmonious with the blocks 10,20, and which may become dislodged from the blocks 10,20 over time. In particular, the interfaces between the cable 15 and the two blocks 10,20 can constitute a structural weak points of the component.

Further, the manner in which the first and second electrical conductors 65,70 are constructed and positioned in relation to the blocks 10,20 limits the usefulness of the component 5. As shown, the flat panel sections 75 of the first and second electrical conductors 65 and 70 are positioned only along the first and second internal walls 85 and 90, and the first and second electrical conductors only protrude from the protrusions 30 at the outward-facing segments 95 of the protrusions. Consequently, if a block like that of blocks 10,20 (e.g., from another one of the components 5) is to be successfully coupled electrically to the bottom side 55 of one of the blocks 10,20, that block must be oriented so that its respective first and second rows of protrusions are aligned with the first and second rows 45,60 of indentations of the one of the blocks 10,20 to which it is attached. Likewise, if a block like the blocks 10,20 is to be successfully coupled electrically to the top side 35 of one of the blocks 10,20, that block must be oriented so that its respective first and second rows of indentations are aligned with the first and second rows 25,40 of protrusions of the one of the blocks 10,20 to which it is attached. Otherwise, the flat panel sections 75 of the electrical conductors 65,70 of one block will not be in contact with the portions of the electrical conductors of the other block that are exposed within the segments 95 of that block, and no electrical connections will be established. Thus, two of the blocks cannot be assembled in a manner in which the blocks only are in contact along one of the rows 25,40 of protrusions of one of the blocks and one of the rows 45,60 of indentations of the other of the blocks (e.g., in a staggered manner).

Additionally, because adjacent protrusions 30 of each of the rows 25,40 of each of the blocks 10,20 are short-circuited with one another, and similarly because adjacent indentations 50 of each of the rows 45,60 of each of the blocks 10,20 are short-circuited with one another, any voltage differential between the first and second electrical conductors 65,70 can become short-circuited when two or more blocks that are the same as the blocks 10,20 are stacked above one another in an improper orientation. In particular, if two blocks are stacked in a manner where the rows 25,40 of one the blocks are perpendicular to the rows 45,60 of the other of the blocks, then a voltage differential existing on at least one of the blocks will be short-circuited. Thus, the design of the component 5 does not facilitate the communication of a voltage differential by way of the stacking of blocks, since blocks must be stacked in a particular manner for such a voltage differential to be properly communicated from the bottom of the stack to the top of the stack.

Therefore, given the limitations of conventional block toy components such as those shown in FIGS. 1 and 2, it would be advantageous if an improved electrical block toy component could be developed. In particular, it would be advantageous if such a component allowed for the communication of a voltage differential over a distance. Additionally, it would be advantageous if such a component allowed for the communication of a voltage differential over a distance without the use of externally visible wires or other externally-visible or structurally weak non-block components. Further, it would be advantageous if such a component was easy to construct and manufacture, robust, and consistent in aesthetic appearance and function with standard block toy components of its corresponding block toy system.

Additionally, it would be advantageous if such a component was designed so that, whenever the component was assembled to another similar interface component in any manner consistent with the normal manner of assembling block components of that type, electrical connections were successfully created regardless of the particular orientation of assembly. For example, with respect to LEGO®-type block components, it would be advantageous if electrical connections could be created between two block components whenever one or more indentations of one of the components received one or more corresponding protrusions of the other of the components, regardless of whether pairs of indentations of one component were aligned with pairs of protrusions of the other components, or whether all or some of the indentations of one component were in contact all or some of the protrusions of the other component. Additionally, it would be advantageous if the components were designed in such a manner that, regardless of the orientation of components that were affixed to one another, a voltage differential applied to one component in a stack of components would always be properly transmitted to another one of the components in the stack, without any short-circuiting of the voltage differential occurring due to the relative orientation of the components.

SUMMARY OF THE INVENTION

The present inventors have realized that an electrically conductive block component can be constructed by inserting a plurality of pins into corresponding sockets within a rectangular block portion. Heads of the pins at first ends of the pins extend out of a top face of the rectangular block portion to form protrusions, while indentations exist within the opposite ends of the pins along a bottom face of the rectangular block portion, where the indentations are capable of receiving and being connected to corresponding protrusions from other block components. Because the entire circumferences of the heads of the pins, and the entire inner surfaces of the indentations, are electrically conductive, electrical connections can be established between two of the electrically conductive block components regardless of the relative orientations of the block components, so long as one or more of the protrusions of one block component are connected to one or more of the indentations of another block component.

The present inventors have further realized that, by internally short-circuiting only those pins on a block component that are positioned diagonally with respect to one another, the block component is thus configured to have two sets of pins that are electrically isolated from one another and that can coexist with a voltage differential between the two sets of pins. Further, because adjacent pins within a given row of pins (rather than pins from different rows that are diagonally-neighboring) are always electrically isolated from one another, two of the block components of this type can be assembled in any orientation without short circuiting the voltage differential between the two sets of pins. Consequently, an inexperienced user can easily connect or stack multiple such electrically conductive block components, in any orientation, and successfully provide a voltage differential from a first location at one of the block components to a second location at one of the other block components.

In particular, the present invention relates to an electrically conductive block component. The electrically conductive block component includes a main block section having first and second faces opposed to one another and a first channel extending through the main block section from the first face to the second face. The electrically conductive block component further includes a first conductive pin positioned within the first channel and having first and second end portions proximate the first and second faces, respectively. The first and second end portions of the first conductive pin are configured so that the electrically conductive block component can be both physically assembled with and electrically coupled to another electrically conductive block component.

The present invention further relates to an electrically conductive block component. The electrically conductive block component includes a main block section having a plurality of channels extending between first and second surfaces of the main block section, and a plurality of electrically conductive pins. Each pin is inserted within a respective one of the channels, and each pin has a respective head forming a respective protrusion out of the first surface and a respective base including a respective indentation recessed into the second surface. The electrically conductive block component additionally includes at least one connection that electrically couples at least two of the electrically conductive pins.

The present invention additionally relates to a method of producing an electrically conductive block component. The method includes providing a main block section having first and second faces and a first channel extending from the first face to the second face, and inserting a first electrically conductive pin into the first channel so that the pin extends from proximate the first face to proximate the second face. Upon being inserted sufficiently far into the first channel, the first electrically conductive pin is fixed in position with respect to the main block section.

DETAILED DESCRIPTION OF THE PREFERRED EMBODIMENT

Figure 1:
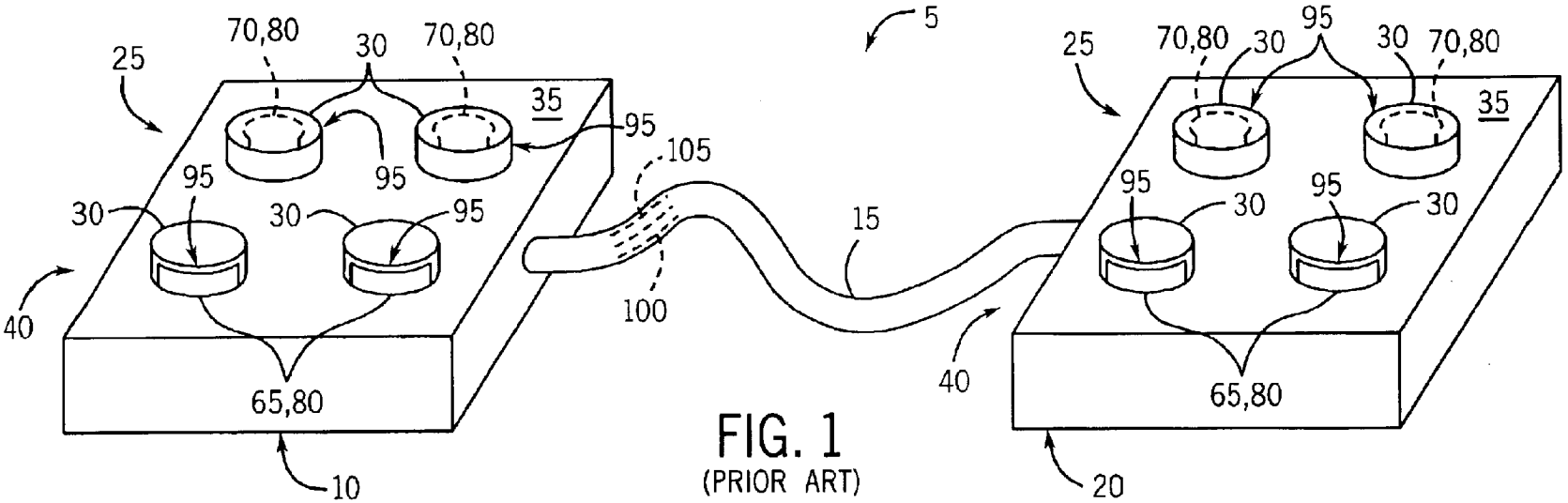
FIG. 1 (PRIOR ART)
FIG. 1 is a top perspective view of a Prior Art electrically conductive block component.
Figure 2:
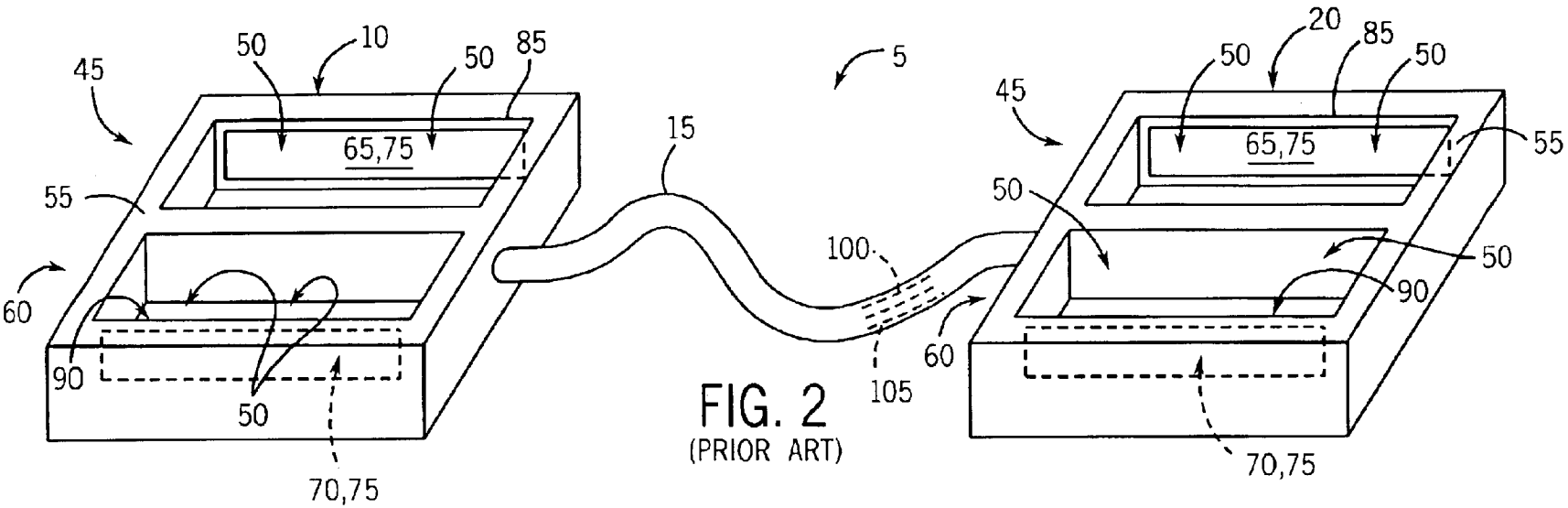
FIG. 2 (PRIOR ART)
FIG. 2 is a bottom perspective view of the component of FIG. 1.
Figure 3:
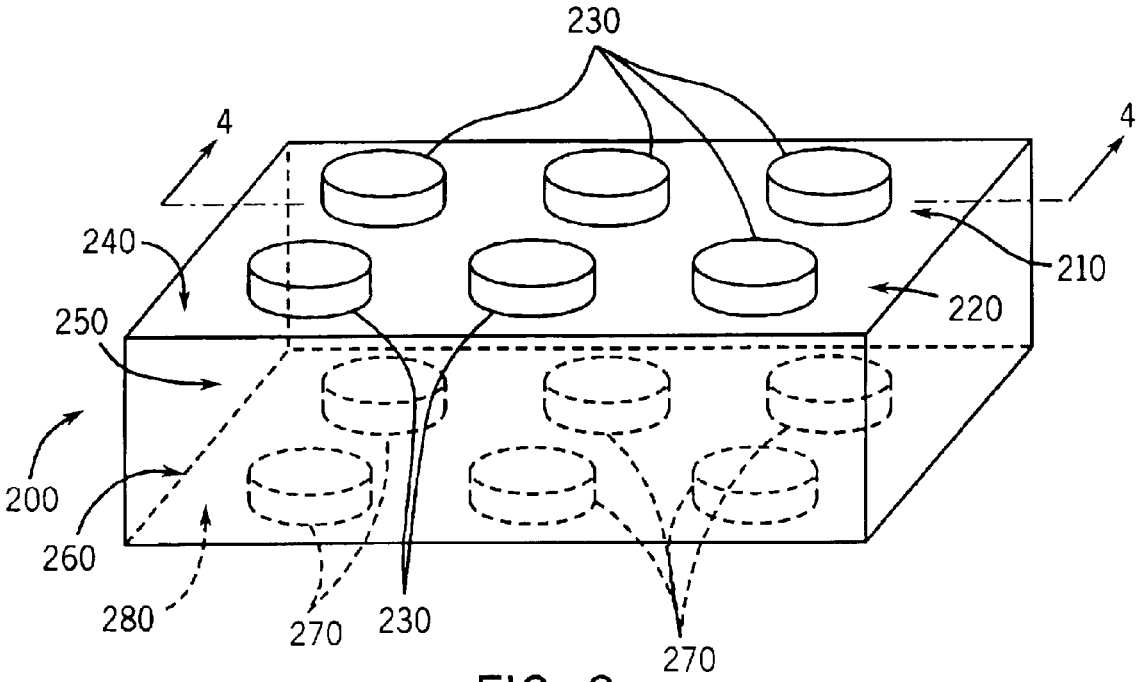
FIG. 3 is a top perspective view of an exemplary electrically conductive block component in accordance with an embodiment of the present invention.

Referring to FIG. 3, a perspective view of an exemplary electrically conductive block component 200 shows the block component to be rectangular with respective first and second rows 210, 220 of protrusions 230 protruding from a top face 240 of the block component. In the embodiment shown, each of the first and second rows 210, 220 includes three of the protrusions 230, although in alternate embodiments, the number of protrusions per row could vary. Indeed, depending upon the embodiment, the number of rows 210, 220 could also vary. For example, the block component 200 could also be a block component having only one protrusion 230 in a single row or a block component with nine protrusions 230 arranged in three rows.

Also shown in FIG. 3, in phantom, are respective first and second rows 250, 260 of indentations 270 recessed inward into a bottom face 280 of the block component 200. Each of the rows of indentations 250, 260 includes three of the indentations 270, to match the protrusions 230 along the top face 240. In alternate embodiments, in which the number and/or arrangements of protrusions 230 varies from that shown in FIG. 3, typically the arrangement of indentations 270 would be changed to match that of the corresponding protrusions. However, it is possible that, in some alternate embodiments, a block component would include one or more protrusions 230 that were unmatched by corresponding indentations 270, or vice versa.

The block component 200 is generally in the form of a LEGO® type block component and is capable of being connected to other block components of the LEGO® type. However, the present invention is also capable of being implemented with respect to block components for use with block toy systems other than the LEGO® systems. For example, while the LEGO® type blocks typically have cylindrical shaped protrusions 230, other types of block components may have rectangular shaped protrusions or protrusions of other shapes, as well as indentations capable of receiving such protrusions. The block component 200 need not be rectangular. The present invention is intended to be applicable with respect to all of these other types of block toy systems.

Figure 4:
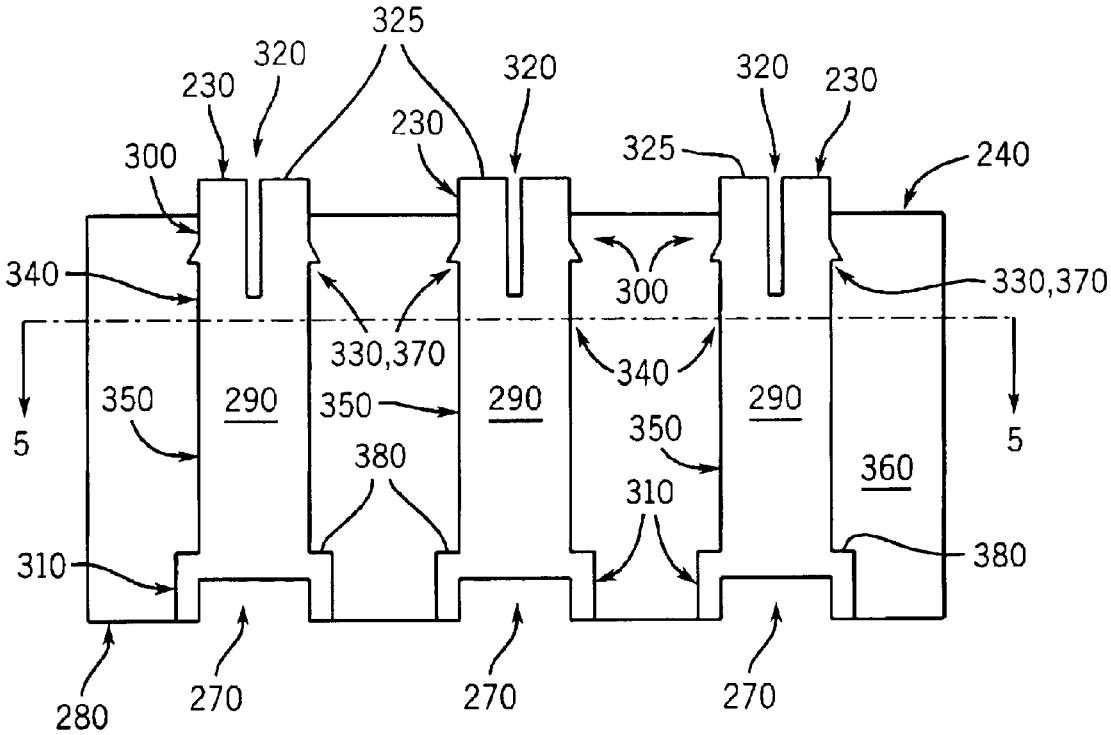
FIG. 4 is a cross-sectional view of the exemplary electrically conductive block component of FIG. 3, taken along line 4-4 of FIG. 3.

Referring to FIG. 4, a cross-sectional view of the electrically conductive block component 200 taken along line 4-4 is shown. As is evident from FIG. 4, in accordance with one embodiment of the present invention, the protrusions 230 and indentations 270 are formed by pins 290 that extend through a main block portion 360 of the block component 200 from its bottom face 280 to (and out of) its top face 240. As shown, each of the pins 290 has a respective head 300, respective top portions of which form the protrusions 230. Also, each of the pins 290 includes a respective base 310, in which is formed a respective one of the indentations 270. Further, as shown, each of the heads 300 of the respective pins 290 includes a respective slot 320 through, and a respective locking ridge 330 around, the head 300 of the pin 290. The respective slot 320 of each pin 290 extends from a respective upper end 325 of the pin up to a respective interior section 340 of the pin.

The pins 290 are made from one or more electrically conductive materials such as copper or steel, such that each of the pins 290 provides a short circuit between its respective protrusion 230 and indentation 270. To construct the block component 200, each of the pins 290 is inserted into a respective channel 350 within the main block portion 360. The pins 290 are inserted with the heads 300 first. The slots 320, which allow the circumferences of the heads to be slightly reduced during insertion, facilitate the insertion of the pins, which would otherwise be more difficult due to the presence of the locking ridges 330. Once the respective pins 290 are inserted all of the way into their respective channels 350, the respective ridges 330 fit into respective complementary notches 370 of the main block portion 360, thus locking the respective pins 290 with respect to the main block portion 360 so that the pins do not slide back out of the bottom face 280 of the block component 200. Additionally, the bases 310 of the pins 290 include ridges 380 that prevent the pins 290 from being inserted too far into the respective slots 350. Thus, the pins 290 snap into place within the main block portion 360 and are locked in relation to the main block portion, thereby forming a robust block component 200 with the multiple protrusions 230 and indentations 270.

Figure 5:
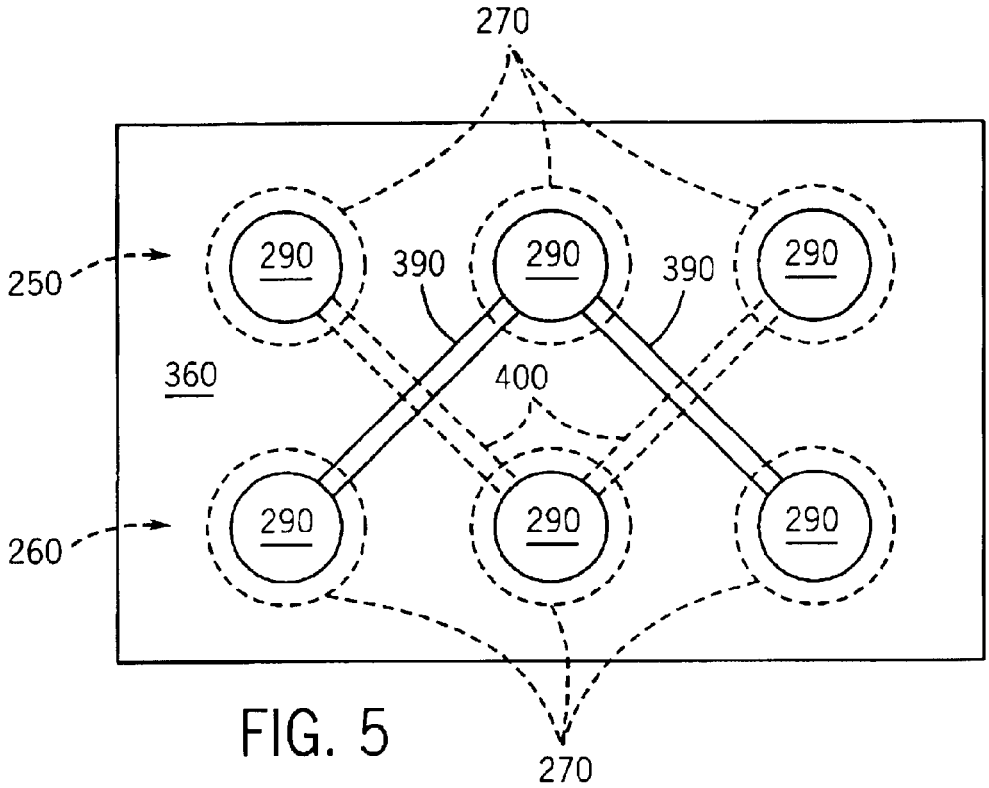
FIG. 5 is a cross-sectional view of the exemplary electrically conductive block component of FIGS. 3 and 4, taken along line 5-5 of FIG. 4.

In certain embodiments, the block components such as the block component 200 additionally are designed to provide for electrical connections between multiple pins 290. For example, FIG. 5 shows a cross-sectional view of a preferred embodiment of the block component 200 taken along line 5-5 of FIG. 4, in which pins 290 that are positioned diagonally apart from one another are electrically connected (short circuited) by way of connections 390, 400 existing within the interior of the main block portion 360. Specifically, as shown in FIG. 5, the middle one of the three pins 290 forming the middle indentation 270 of the first row of indentations 250 is coupled to both of the outside pins 290 forming the outermost (e.g., first and third) indentations 270 of the second row of indentations 260. The connections 390 between these three pins 290 are embedded within the main block portion 360 and can be, for example, discrete wires that run parallel to the top and bottom faces 240, 280 between the respective diagonally-positioned pins 290. Also as shown in phantom, the middle one of the pins 290. forming the middle indentation 270 of the second row 260 of indentations is coupled by way of the connections 400 to the outside pins 290 forming the outermost indentations 270 of the first row 250 of indentations. The additional connections 400 also can be, for example, discrete wires that run parallel to the top and bottom faces 240, 280 of the block component 200.

Because the respective connections 390 and connections 400 connect alternating sets of diagonally-positioned pins 290, the connectors 390 and additional connectors 400 crisscross one another. In order that the crisscrossing connections 390, 400 remain electrically isolated, so that the respective sets of pins 290 coupled to the different connections also are electrically isolated from one another within the block component 200 and thus can be maintained at different voltages, the connections 390 are typically positioned at a different level between the bottom and top faces 240, 280 than the additional connections 400. In the embodiment shown, for example, the connections 390 are positioned at a higher level (e.g., closer to the top face 240) than the additional connections 400. In certain embodiments, the main block portion 360 can be formed by way of a molding layering process, in which the additional connections 400 are positioned above a bottom layer of plastic that forms the bottom face 280, a middle layer of plastic is positioned on top of the additional connections 400, the connections 390 are positioned above the middle layer, and a top layer of plastic is finally provided above the connections 390, where the top layer also forms the top face 240 of the main block portion 360. Thus, the connections 390 are electrically isolated from the additional connections by the middle layer of plastic.

Figure 6:
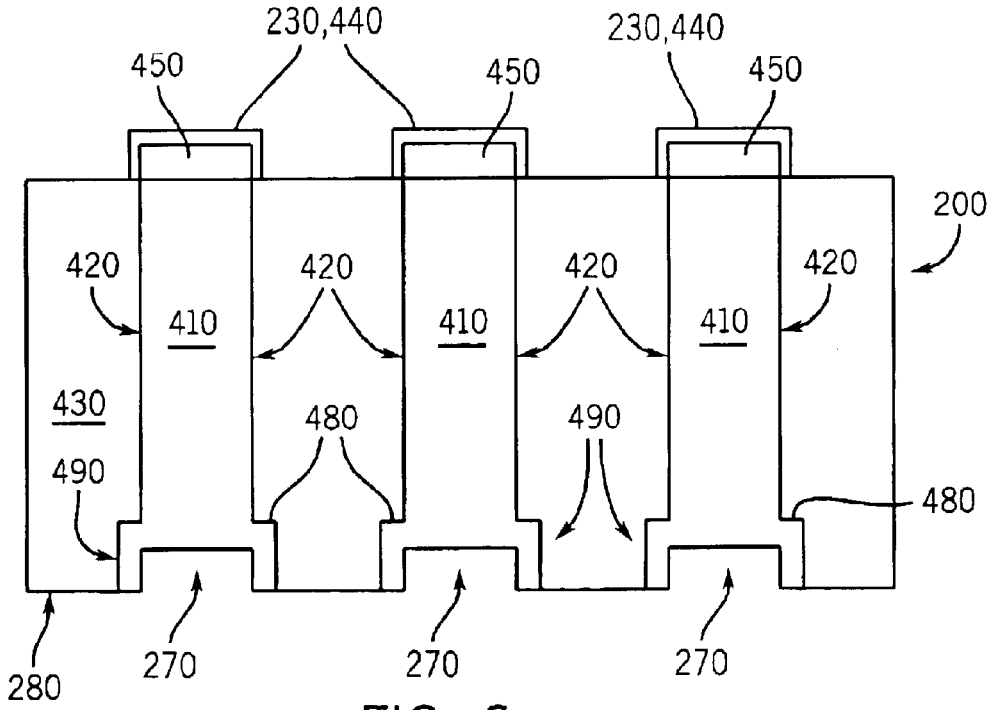
FIG. 6 is an alternate embodiment of the cross-sectional view of the exemplary electrically conductive block component shown in FIG. 4.

Turning to FIG. 6, an alternate cross-sectional view of the block component 200 of FIG. 3 taken along line 4-4 is shown. In this embodiment, pins 410 are still inserted within corresponding channels 420 of a main block portion 430 of the block component 200. However, in order to retain the pins 410 in their channels 420, caps 440 are positioned respectively over heads 450 of the pins 410. The caps 440, which form the outer surfaces of the protrusions 230 of the block component 200, are electrically conductive and are pressed onto the heads 450 of the pins 410. Because the outer circumference of the caps 450 is larger than the diameter of the channels 420, the pins 410 are locked in place and prevented from coming out of the bottom face 280 of the block component 200. Also, the pins 410 again include ridges 480 around their respective bases 490 that preclude the pins from being inserted too far into the main block portion 430. The embodiments shown in FIGS. 5 and 6 are only intended to be exemplary of a variety of different designs of electrically conductive block components that can be simply assembled to allow for electrical connections between respective indentations 270 and protrusions 230 of the block component.

Figure 7:
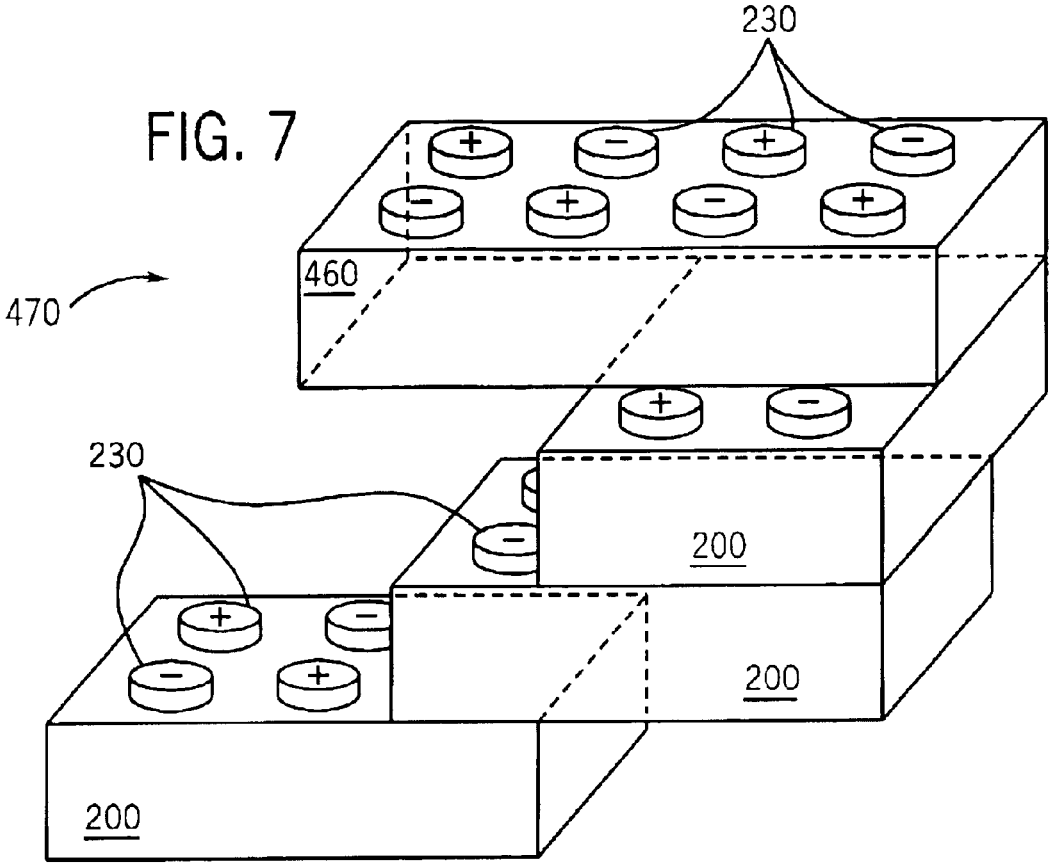
FIG. 7 is a top perspective view of an assembly of multiple electrically conductive block components in accordance with an embodiment of the present invention.

Referring to FIG. 7, several of the block components 200 are shown to be assembled with one another and with an additional block component 460 to form a larger block assembly 470. The block assembly 470 is only intended to be exemplary of a variety of block assemblies that could be constructed using one or more of the block components 200, 460 or other block components. That is, the assembly 470 is exemplary of other assemblies constructed from block components that have fewer or larger numbers of protrusions 230 and indentations 270 than the block components 200 and the additional block component 460 (which has first and second rows of four protrusions and first and second rows of four indentations).

As shown in FIG. 7, assuming that each of the block components 200 and 460 employ connections such as those of FIG. 5 that connect diagonally-positioned pins (and their respective protrusions and indentations), a voltage differential can be transmitted across multiple blocks. FIG. 7 shows how two different voltage potentials at two sets of pins (and thus a voltage differential between those respective sets of pins) is transmitted by the blocks by showing respective plus signs on those of the protrusions 230 that would have a first voltage potential and respective negative signs on those of the protrusions that would have a second voltage potential.

Block components in which diagonally-positioned pins (rather than adjacent pins) are connected to one another are especially advantageous insofar as the block components having this configuration can be assembled with one another in any orientation without resulting in the short-circuiting of the two sets of pins and any voltage differential between them. Thus, a child constructing an assembly such as the assembly 470 with the block components can easily provide a voltage differential and thus communicate power from one location in the assembly to another without having to follow any specialized rules of assembly other than the normal manner of assembling the block components. Further, this embodiment of block components is advantageous insofar as it eliminates the need for wires that could negatively impact the aesthetic appearance of the blocks or compromise the blocks'robustness. In essence, the block components integrate the electrical componentry of the blocks with the physical structure/shape of the blocks.

Figure 8:
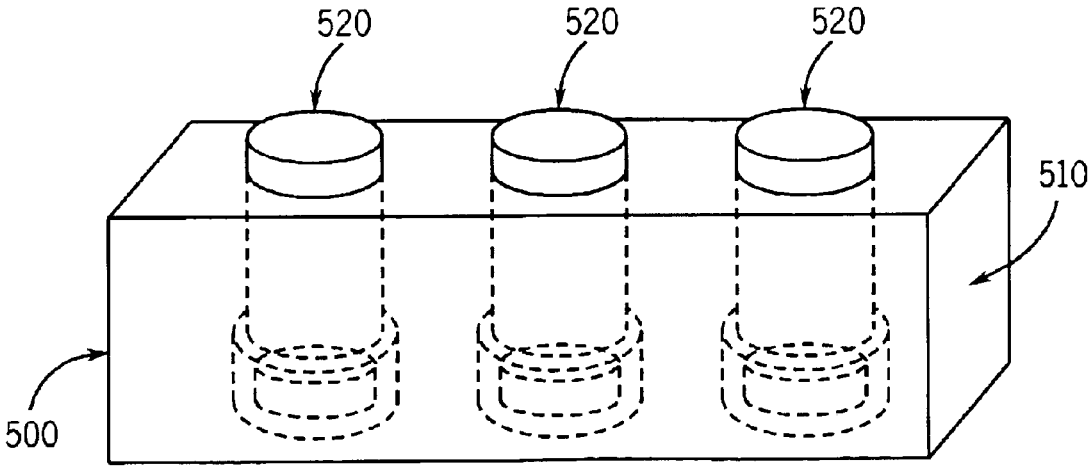
FIG. 8 is a top perspective view of another exemplary electrically conductive block component in accordance with another embodiment of the present invention.

Turning to FIG. 8, an alternate embodiment of the invention shows a block component 500 that employs pins 520 (which can be of any of the types discussed above, including the pins 290 and pins 410). In this example, the block component 500 only has a single row 510 of the pins 520 and corresponding indentations and protrusions. Preferably, the pins 520 are electrically isolated from one another rather than coupled to one another by any connections. By electrically isolating the pins 520 of the block component 500 from one another, voltage differentials carried by other block components such as the block components 200,460 described above are not short-circuited when those other block components are coupled to the block component 500.

The present invention is generally applicable to block components having a different number and arrangement of pins and corresponding protrusions and indentations, and to a variety of other types of block components than those shown in FIGS. 3–8. Also, while not preferred, the present invention includes embodiments in which adjacent pins rather than just diagonally-positioned pins are electrically coupled to one another.

Many other modifications and variations of the preferred embodiment which will still be within the spirit and scope of the invention will be apparent to those with ordinary skill in the art. In order to apprise the public of the various embodiments that may fall within the scope of the invention, the following claims are made.

We claim:

1. An electrically conductive block component comprising:

a main block section having first and second faces opposed to one another and a first channel extending through the main block section from the first face to the second face, wherein the respective first and second faces are substantially outermost surfaces of the main block section; and a first conductive pin positioned within the first channel and having first and second end portions proximate the first and second faces, respectively, wherein the first and second end portions of the first conductive pin are configured so that the electrically conductive block component can be both physically assembled with and electrically coupled to another electrically conductive block component, wherein the first and second end portions of the first conductive pin have first and second complementary shapes, and wherein the first end portion of the first conductive pin is a head forming a protrusion out of the main block section beyond the first face, and the second end portion of the first conductive pin is a base including an indentation recessed into the second face of the main block section, wherein the indentation is complimentary in shape with respect to the protrusion.

2. The electrically conductive block component of claim 1, wherein each of the protrusion and indentation is one of cylindrical and rectangular, and wherein the main block section is rectangular.

3. The electrically conductive block component of claim 1, wherein the electrically conductive block component is assembled by inserting the first conductive pin into the first channel with the head proceeding first into the first channel followed by the base.

4. An electrically conductive block component comprising:

a main block section having first and second faces opposed to one another and a first channel extending through the main block section from the first face to the second face; and a first conductive pin positioned within the first channel and having first and second end portions proximate the first and second faces, respectively, wherein the first and second end portions of the first conductive pin are configured so that the electrically conductive block component can be both physically assembled with and electrically coupled to another electrically conductive block component, wherein the first end portion is a head and the second end portion is a base, and wherein the electrically conductive block component is assembled by inserting the first conductive pin into the first channel with the head proceeding first into the first channel followed by the base, wherein the first conductive pin includes a slot extending parallel to an axis of the first conductive pin through the head, and a first ridge on the head, wherein the first ridge extends beyond an outer perimeter of a remaining portion of the head, and wherein the first channel includes a notch capable of receiving the first ridge when the first conductive pin is inserted into the first channel.

5. The electrically conductive block component of claim 4, wherein the first conductive pin is cylindrical, and wherein an outer diameter of the first conductive pin is larger proximate the base of the first conductive pin than along a remaining portion of the first conductive pin including the head, so that the base forms a second ridge along the first conductive pin, and wherein the first and second ridges lock the first conductive pin in position with respect to the main block section after being inserted therein.

6. An electrically conductive block component comprising:

a main block section having first and second faces opposed to one another and a first channel extending through the main block section from the first face to the second face; and a first conductive pin positioned within the first channel and having first and second end portions proximate the first and second faces, respectively, wherein the first and second end portions of the first conductive pin are configured so that the electrically conductive block component can be both physically assembled with and electrically coupled to another electrically conductive block component, and wherein the first conductive pin includes a main pin portion and a cap at the first end portion, and wherein the block component is assembled by inserting the main pin portion into the first channel and then affixing the cap onto an end of the main pin portion that protrudes out beyond the first face.

7. An electrically conductive block component comprising:

a main block section having first and second faces opposed to one another and a first channel extending through the main block section from the first face to the second face, wherein the respective first and second faces are substantially outermost surfaces of the main block section; and a first conductive pin positioned within the first channel and having first and second end portions proximate the first and second faces, respectively, wherein the first and second end portions of the first conductive pin are configured so that the electrically conductive block component can be both physically assembled with and electrically coupled to another electrically conductive block component, and further comprising a second conductive pin positioned within a second channel of the main block section, wherein the second conductive pin additionally has respective first and second end portions proximate the first and second faces, respectively, and wherein the first and second conductive pins are electrically coupled by a first connection.

8. The electrically conductive block component of claim 7, further comprising:

a third conductive pin positioned within a third channel of the main block section, wherein the third conductive pin additionally has respective first and second end portions proximate the first and second faces, respectively, and a fourth conductive pin positioned within a fourth channel of the main block section, wherein the fourth conductive pin additionally has respective first and second and portions proximate the first and second faces, respectively.

9. The electrically conductive block component of claim 8, wherein the first and third conductive pins are positioned along a first row, wherein the second and fourth conductive pins are positioned along a second row, and wherein the first and second rows are parallel to one another within the block component.

10. The electrically conductive block component of claim 9, wherein the first and second conductive pins are at opposite ends of their respective rows, and the third and fourth conductive pins are at opposite ends of their respective rows, so that each of the first and second conductive pins is adjacent to the third conductive pin and the fourth conductive pin, and so that the first and second conductive pins are positioned diagonally apart from one another.

11. The electrically conductive block component of claim 10, wherein the third and fourth conductive pins also are positioned diagonally apart from one another, and are electrically coupled to one another by a second connection.

12. The electrically conductive block component of claim 11, wherein the first and second connections extend internally within the main block section between the first and second conductive pins and the third and fourth pins, respectively, and wherein the first and second connections crisscross one another.

13. The electrically conductive block component of claim 12, wherein the main block section includes first, second and third layers of plastic material, wherein the first connection is positioned in between the first and second layers of plastic material and the second connection is positioned in between the second and third layers of plastic material, so that the first and second connections are electrically isolated from one another.

14. An electrically conductive block component comprising:

a main block section having a plurality of channels extending between first and second surfaces of the main block section;

a plurality of electrically conductive pins, wherein each pin is inserted within a respective one of the channels, and wherein each pin has a respective head forming a respective protrusion out of the first surface and a respective base including a respective indentation recessed into the second surface; and at least one connection tat electrically couples at least two of the electrically conductive pins.

15. The electrically conductive block component of claim 14, wherein each of the electrically conductive pins includes means for locking the respective pin in position with respect to the main block section; and wherein the at least one connection includes a first set of connections that electrically couples a first diagonally-positioned set of the plurality of pins together, and electrically couples a second diagonally-positioned set of the plurality of pins together, so that the first and second sets of pins are electrically isolated with respect to one another.

16. An electrically conductive block component comprising:

a main block section;

a first row of electrical contacts, each of which is formed, respectively, as part of a respective physical connection feature on a first surface of the main block section;

a second row of electrical contacts, each of which is formed, respectively, as part of a respective physical connection feature on the first surface, and wherein the first row and second row are parallel to one another and aligned with one another so that each electrical contact of the first row is positioned alongside a respective one of the electrical contacts of the second row; and a plurality of electrical connectors electrically coupling the electrical contacts of the first row with the electrical contacts of the second row, wherein each of the electrical connectors electrically couples a respective one of the electrical contacts of the first row with a respective one of the electrical contacts of the second row that is diagonally positioned relative to the one of the electrical contacts of the first row.

17. The electrically conductive block component of claim 16, further comprising:

a third row of electrical contacts, each of which is formed, respectively, as part of a respective physical connection feature on a second surface of the main block section; and a fourth row of electrical contacts, each of which is formed, respectively, as part of a respective physical connection feature on the second surface, and wherein the third and fourth rows are parallel to one another and aligned with one another so that each electrical contact of the third row is positioned alongside a respective one of the electrical contacts of the fourth row;

wherein each of the electrical contacts of the third row is electrically coupled to a respective one of the electrical contacts of the first row, and wherein each of the electrical contacts of the fourth row is electrically coupled to a respective one of the electrical contacts of the second row.

18. The electrically conductive block component of claim 16, wherein the main block section includes first, second and third layers of plastic material, wherein at least a first of the electrical connectors is positioned in between the first and second layers of plastic material and at least a second of the electrical connectors is positioned in between the second and third layers of plastic material, so that the first and second electrical connectors arc electrically isolated from one another.

* * * * *